US010214845B1

(12) United States Patent
Hernandez

(10) Patent No.: US 10,214,845 B1
(45) Date of Patent: Feb. 26, 2019

(54) WASHING MACHINE ASSEMBLY

(71) Applicant: Islay Hernandez, Miami, FL (US)

(72) Inventor: Islay Hernandez, Miami, FL (US)

( * ) Notice: Subject to any disclaimer, the term of this patent is extended or adjusted under 35 U.S.C. 154(b) by 10 days.

(21) Appl. No.: 15/627,520

(22) Filed: Jun. 20, 2017

(51) Int. Cl.
*D06F 37/06* (2006.01)
*D06F 39/02* (2006.01)
*D06F 39/00* (2006.01)

(52) U.S. Cl.
CPC ..... *D06F 37/06* (2013.01); *D06F 39/005* (2013.01); *D06F 39/022* (2013.01); *D06F 39/026* (2013.01)

(58) Field of Classification Search
None
See application file for complete search history.

(56) References Cited

U.S. PATENT DOCUMENTS 2,285,547 A * 6/1942 Whelan ..... D06F 95/006 210/237
3,145,551 A * 8/1964 Ziegler ..... D06F 13/00 210/380.2
5,546,771 A * 8/1996 Bonar ..... A47L 15/0097 134/115 R
7,401,479 B2 * 7/2008 Fields ..... D06F 39/00 211/163
2004/0231063 A1 * 11/2004 Rhode ..... D06F 37/08 8/159
2005/0196075 A1 * 9/2005 Heidel ..... D06F 95/006 383/38
2007/0084254 A1 * 4/2007 Messina ..... D06F 95/002 68/142
2008/0034810 A1 * 2/2008 Bextermoeller ..... D06F 39/14 68/12.26
2008/0226204 A1 * 9/2008 Sabounjian ..... D06F 95/006 383/74
2013/0115130 A1 * 5/2013 Kappler ..... D06F 95/002 422/5
2015/0143856 A1 * 5/2015 Jo ..... D06F 39/02 68/17 R

* cited by examiner

*Primary Examiner* — Jason Y Ko
*Assistant Examiner* — Cristi J Tate-Sims
(74) *Attorney, Agent, or Firm* — Albert Bordas, P.A.

(57) ABSTRACT

A washing machine assembly having a washing machine with an electronic control panel, a refill drawer assembly, and a drum having at least one drum paddle. A basket assembly mounts onto the at least one drum paddle. The basket assembly has at least one basket to contain articles therein to wash, and an elongated curved wall. The basket assembly may have first and second baskets. The at least one basket has first and second walls, an outer lateral wall, an inner lateral wall, and a bottom wall, which are grated. The refill drawer assembly has at least one refill housing that stores and dispenses at least one agent within the washing machine. The electronic control panel is positioned onto an interior panel of the refill drawer assembly. The washing machine further has a light emitting diode system.

14 Claims, 4 Drawing Sheets

WASHING MACHINE ASSEMBLY

BACKGROUND OF THE INVENTION

1. Field of the Invention

The present invention relates to washing machines, and more particularly, to washing machines with basket assemblies and refill drawer assemblies.

2. Description of the Related Art

Applicant is not aware of any washing machines having the novel features of the present invention.

SUMMARY OF THE INVENTION

The present invention is a washing machine assembly comprising a washing machine, which has an electronic control panel, a refill drawer assembly, and a drum having at least one drum paddle. The present invention further comprises a basket assembly that mounts onto the at least one drum paddle.

The basket assembly comprises at least one basket to contain articles therein to wash, and an elongated curved wall. In a preferred embodiment, the basket assembly comprises first and second baskets to contain articles therein to wash, and an elongated curved wall that joins the first and second baskets. The at least one basket comprises first and second walls, an outer lateral wall, an inner lateral wall, and a bottom wall. The bottom wall is curved to contour the drum. The first and second walls, the outer lateral wall, the inner lateral wall, and the bottom wall define a cavity. The at least one basket further comprises a cover door. The cover door comprises a lock that secures onto a latch. The first and second walls, the outer lateral wall, the inner lateral wall, the bottom wall, and the cover define a wire basket assembly, or otherwise are grated to allow fluids to easily flow therethrough. The elongated curved wall comprises at least one hole and is mounted onto the drum paddle.

As an example, the articles to wash are clothing that include, but are not limited to, underwear, caps, and/or footwear including shoes and socks. The basket assembly is removable.

The refill drawer assembly mounts approximately horizontally within the washing machine. The refill drawer assembly comprises at least one refill housing which has a lid and stores and dispenses at least one agent within the washing machine. The at least one agent is detergent, laundry detergent, bleach, and/or fabric softener. The electronic control panel is positioned exteriorly onto an interior panel of the refill drawer assembly.

The washing machine further comprises a light emitting diode system integrated onto a doorframe of the washing machine to illuminate the drum.

It is therefore one of the main objects of the present invention to provide a washing machine assembly.

It is another object of this invention to provide a washing machine assembly comprising a basket assembly.

It is another object of this invention to provide a washing machine assembly, which has a refill drawer assembly with a control panel.

It is another object of this invention to provide a washing machine assembly with a basket assembly to secure articles of clothing such as, but not limited to, shoes, socks and caps for wash.

It is another object of this invention to provide a washing machine assembly that is of a durable and reliable construction.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
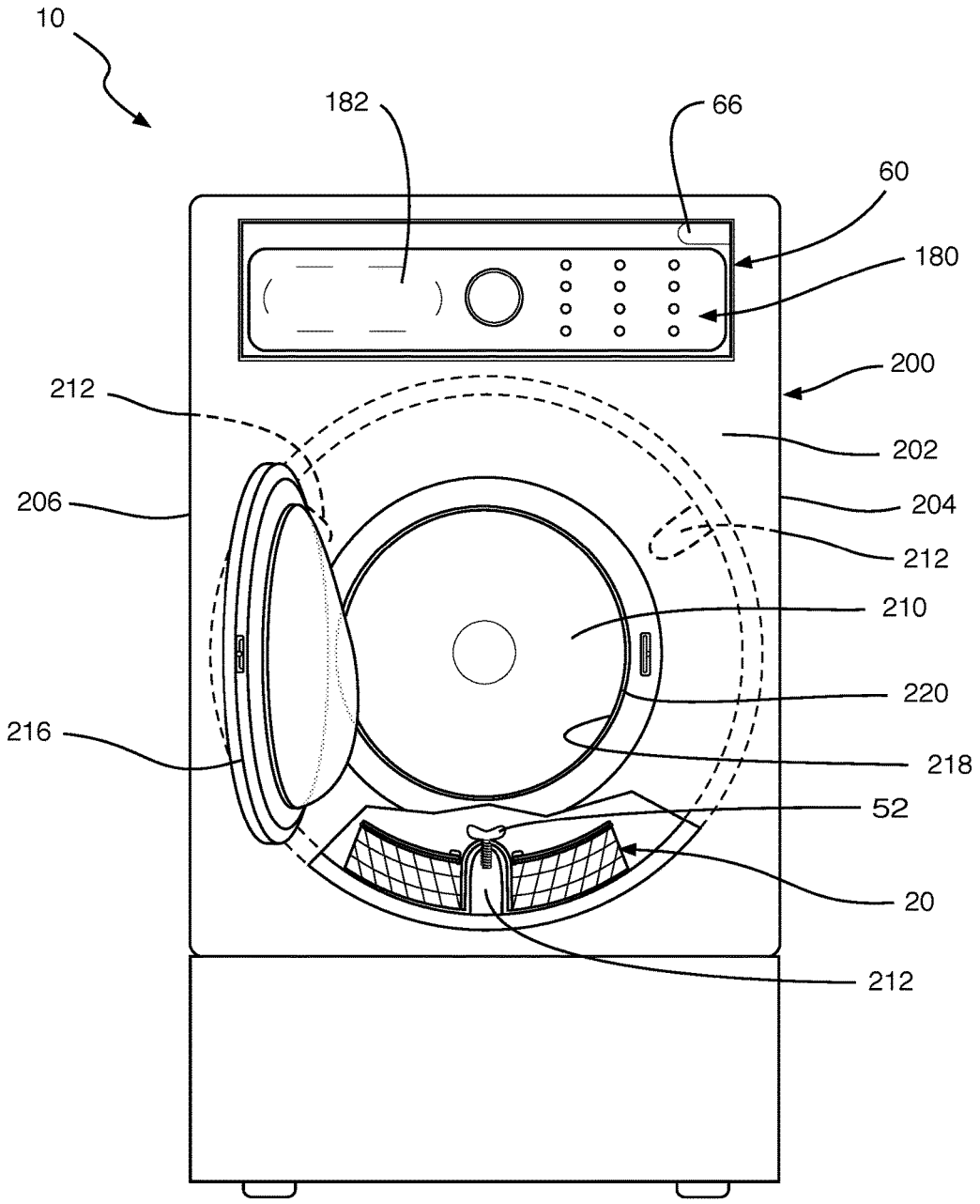
FIG. 1 is a front view of the present invention with a cut view illustrating a drum of the washing machine.

Referring now to the drawings, the present invention is a washing machine assembly and is generally referred to with numeral 10. It can be observed that it basically includes basket assembly 20 with at least one basket 30, refill drawer assembly 60, electronic control panel 180, and washing machine 200.

As seen in FIG. 1, washing machine 200 is an apparatus, especially a household appliance, for washing clothing, linens, etc. Washing machine 200 comprises drum 210 having at least one drum paddle 212, and basket assembly 20 that mounts onto at least one drum paddle 212. Washing machine 200 further comprises front face 202, lateral faces 204 and 206, door 216 with doorframe 220, and a rear face, not seen. Drum 210 is accessible from front face 202. Refill drawer assembly 60 and electronic control panel 180 are positioned on front face 202, wherein refill drawer assembly 60 mounts approximately horizontally within washing machine 200. Electronic control panel 180 comprises touch screen display 182 that serves as an input device and display to operate washing machine 200.

Washing machine 200 further comprises light emitting diode system 218 integrated onto doorframe 220. Light emitting diode system 218 is positioned to illuminate drum 210 and articles of clothing therein, not seen, when washing machine 200 is operating, and when washing machine 200 is stopped to allow better visibility within drum 210.

Refill drawer assembly 60 comprises actuator 66. Actuator 66 is coupled to a soft closing push open hinge, which allows refill drawer assembly 60 to softly open and close when applying a predetermined force on it.

Figure 2:
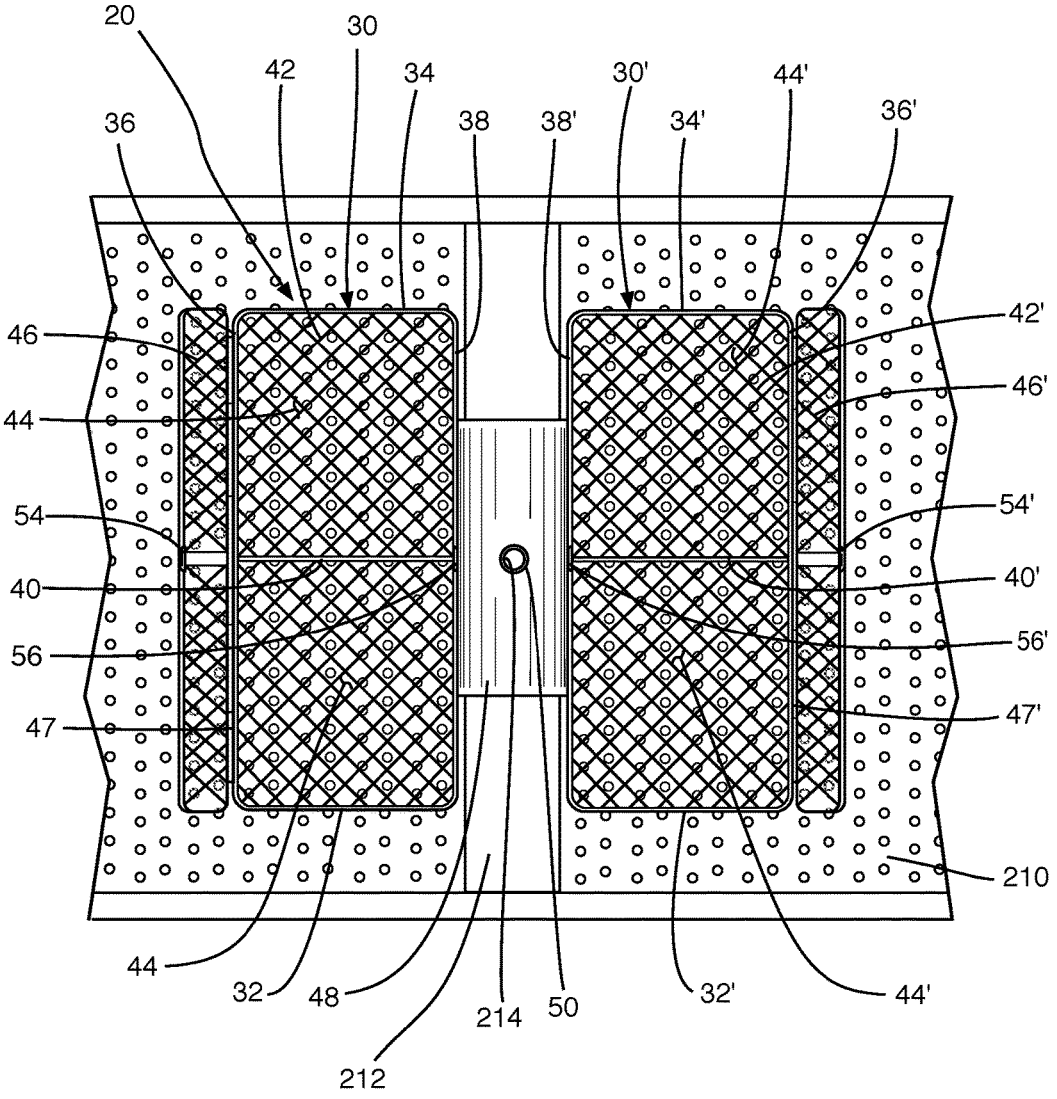
FIG. 2 is a top view of a basket assembly of the present invention mounted onto a drum paddle of the drum seen in FIG. 1.

As seen in FIG. 2, basket assembly 20 comprises at least one basket 30 to contain articles therein to wash, not seen. In a preferred embodiment, basket assembly 20 comprises first basket 30 and second basket 30' to contain articles therein to wash. First and second baskets 30 and 30' respectively comprise first walls 32 and 32', second walls 34 and 34', outer lateral walls 36 and 36', inner lateral walls 38 and 38', and bottom walls 42 and 42'. First and second baskets 30 and 30' are joined by elongated curved wall 48. Elongated curved wall 48 extends from inner lateral wall 38 of basket 30 to inner lateral wall 38' of basket 30', whereby first basket 30 and second basket 30' appear approximately as mirror images. Elongated curved wall 48 is mounted onto drum paddle 212, whereby elongated curved wall 48 is shaped to snugly receive drum paddle 212. Respective first walls 32 and 32', second walls 34 and 34', outer lateral walls 36 and 36', inner lateral walls 38 and 38', dividing walls 40 and 40', and bottom walls 42 and 42' define respective cavities 44 and 44'.

It is noted that each basket 30 and 30' may have one, two, or more cavities 44 and 44' respectively, according to an area inside drum 210. Each basket 30 and 30' further comprises respective cover doors 46 and 46' coupled to respective outer lateral walls 36 and 36' with hinges 47 and 47' respectively. First walls 32 and 32', second walls 34 and 34', outer lateral walls 36 and 36', inner lateral walls 38 and 38', dividing walls 40 and 40', bottom walls 42 and 42', and cover doors 46 and 46' define a wire basket assembly, or are otherwise grated, to allow fluids, detergents, water, etc. to flow within baskets 30 and 30'.

Figure 3:
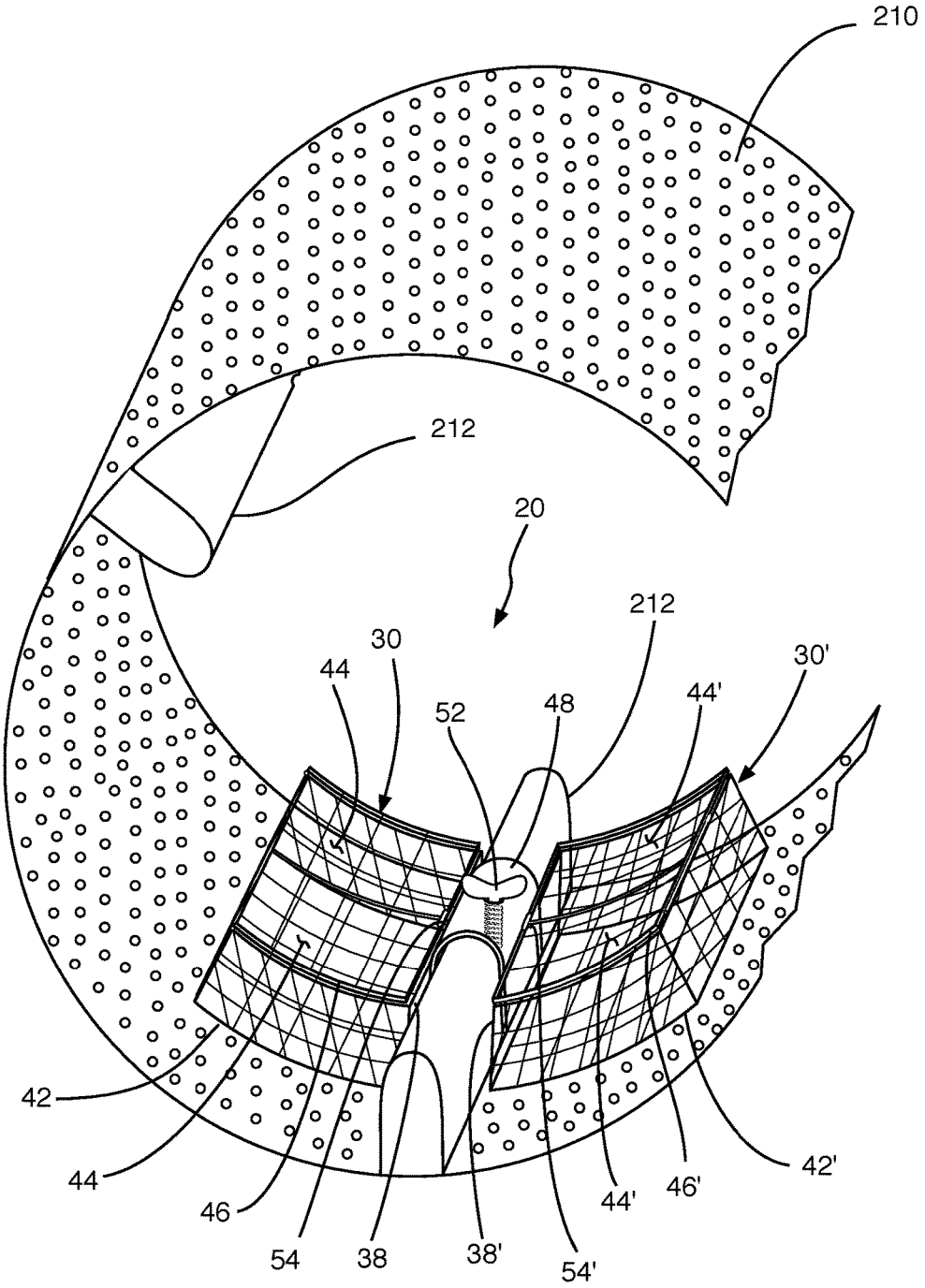
FIG. 3 is a partial isometric view of the basket assembly mounted onto the drum paddle of the drum.

As seen in FIG. 3, basket assembly 20 is positioned within drum 210, whereby elongated curved wall 48 is mounted onto drum paddle 212. In a preferred embodiment, basket assembly 20 comprises at least one security screw 52 that may be a wing head thumb screw. Elongated curved wall 48 comprises at least one hole 50, seen in FIG. 2, approximately centered, which is aligned with at least one hole 214 on drum paddle 212, also seen in FIG. 2. At least one holes 50 and 214 receive security screw 52 to mount basket assembly 20. Basket assembly 20 may be removed from drum paddle 212 when not used. Bottom walls 42 and 42' are curved to contour drum 210.

Basket assembly 20 contains and secures articles therein to wash, wherein the articles may be clothing that include, but are not limited to, underwear, caps, and/or footwear including shoes and socks, not seen. The articles are positioned at cavities 44 and 44', and are secured by respective cover doors 46 and 46'. Cover doors 46 and 46' close onto respective inner lateral walls 38 and 38'. Respective locks 54 and 54' lock upon respective latches 56 and 56', seen in FIG. 2, to keep respective cover doors 46 and 46' closed when the articles are contained therein to wash.

Figure 4:
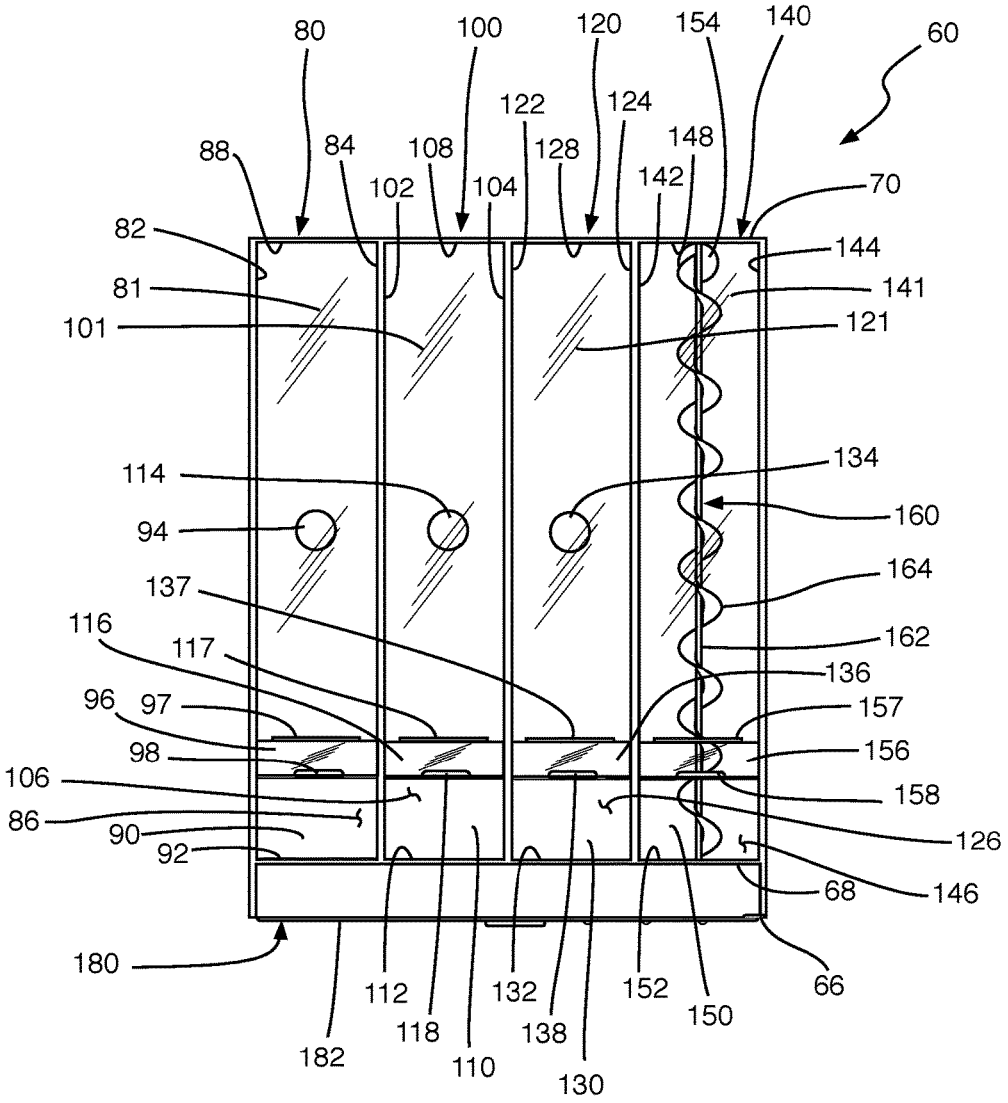
FIG. 4 is a top view of a refill drawer assembly of the present invention comprising four refill housings.

As seen in FIG. 4, refill drawer assembly 60 comprises at least one refill housing that is positioned between interior panel 68 and rear panel 70 for temporarily storing and dispensing at least one agent, not seen, within washing machine 200, seen in FIG. 1. Electronic control panel 180 is positioned exteriorly, or is mounted, onto interior panel 68 of refill drawer assembly 60. In a preferred embodiment, present invention 10 comprises refill housings 80, 100, 120, 140 for storing and dispensing at least one agent. Refill housings 80, 100, 120, 140 are positioned within refill drawer assembly 60, parallel to each other, and extend horizontally from interior panel 68 to rear panel 70.

In a preferred embodiment, refill housing 80 is an elongated housing comprising top wall 81, sidewalls 82 and 84, rear wall 88, base wall 90, and front wall 92 that define cavity 86 to house at least one agent. Refill housing 80 also comprises valve 94, illustrated in an open position, for dispensing said at least one agent within washing machine 200. Refill housing 80 further comprises lid 96. Lid 96 is coupled to top wall 81 with hinge 97 and closes onto front wall 92 with lock 98. Lid 96 is illustrated in an open position, wherein base wall 90 is seen. Top wall 81 and lid 96 are of a transparent material to see within refill housing 80.

In a preferred embodiment, refill housing 100 is an elongated housing comprising top wall 101, sidewalls 102 and 104, rear wall 108, base wall 110, and front wall 112 that define cavity 106 to house at least one agent. Refill housing 100 also comprises valve 114, illustrated in an open position, for dispensing said at least one agent within washing machine 200. Refill housing 100 further comprises lid 116. Lid 116 is coupled to top wall 101 with hinge 117 and closes onto front wall 112 with lock 118. Lid 116 is illustrated in an open position, wherein base wall 110 is seen. Top wall 101 and lid 116 are of a transparent material to see within refill housing 100.

In a preferred embodiment, refill housing 120 is an elongated housing comprising top wall 121, sidewalls 122 and 124, rear wall 128, base wall 130, and front wall 132 that define cavity 126 to house at least one agent. Refill housing 120 also comprises valve 134, illustrated in an open position, for dispensing said at least one agent within washing machine 200. Refill housing 120 further comprises lid 136. Lid 136 is coupled to top wall 121 with hinge 137 and closes onto front wall 132 with lock 138. Lid 136 is illustrated in an open position, wherein base wall 130 is seen. Top wall 121 and lid 136 are of a transparent material to see within refill housing 120.

In a preferred embodiment, refill housing 140 is an elongated housing comprising top wall 141, sidewalls 142 and 144, rear wall 148, base wall 150, and front wall 152 that define cavity 146 to house at least one agent. Refill housing 140 also comprises valve 154, illustrated in an open position, for dispensing said at least one agent within washing machine 200. Refill housing 140 further comprises lid 156. Lid 156 is coupled to top wall 141 with hinge 157 and closes onto front wall 152 with lock 158. Lid 156 is illustrated in an open position, wherein base wall 150 is seen. Top wall 141 and lid 156 are of a transparent material to see within refill housing 140. In an alternate embodiment, any of the at least one refill housings may comprise, as seen for refill housing 140, actuator assembly 160 comprising shaft 162 and at least one blade 164. Actuator assembly 160 is for agent that, as an example, is a powdered laundry detergent. Actuator assembly 160 is powered to rotate shaft 162 to allow agent to exit through valve 154 when in an open position.

At least one agent can be, but is not limited to being liquid, semi-solid, and/or solid, and in a preferred embodiment, at least one agent is detergent, laundry detergent, bleach, and/or fabric softener. Water and/or other cleaning chemicals may also be added to at least one agent.

In another embodiment, drum 210 of washing machine 200 may move vertically and horizontally for easy access when washing machine 200 is stopped.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A washing machine assembly, comprising:

A) a washing machine comprising an electronic control panel, a refill drawer assembly, and a drum having at least one drum paddle, said drum paddle comprising at lease one first hole; and B) a basket assembly that mounts onto said at least one drum paddle, said basket assembly comprising first and second baskets to contain articles therein to wash, each of said first and second baskets comprising first and second walls, an outer lateral wall, an inner lateral wall, and a bottom wall, said first and second baskets are joined by an elongated curved wall, said elongated curved wall comprising at least one second hole and at least one security screw, said at least one first hole and at least one second hole are aligned to receive said at least one security screw to removably mount said curved wall to said drum paddle, each of said first and second baskets comprising respective dividing walls, each of said first and second baskets further comprising respective cover doors hingedly mounted to said outer lateral walls.

2. The washing machine assembly set forth in claim 1, further characterized in that said bottom wall is curved to contour said drum.

3. The washing machine assembly set forth in claim 1, further characterized in that said first and second walls, said outer lateral wall, said inner lateral wall, and said bottom wall define a cavity.

4. The washing machine assembly set forth in claim 1, further characterized in that said at least one basket further comprises a cover door.

5. The washing machine assembly set forth in claim 4, further characterized in that said cover door comprises a lock that secures onto a latch.

6. The washing machine assembly set forth in claim 1, further characterized in that said first and second walls, said outer lateral wall, said inner lateral wall, said bottom wall and said cover door define a wire basket assembly or are grated.

7. The washing machine assembly set forth in claim 1, further characterized in that said articles are underwear, caps, and/or footwear including shoes and socks.

8. The washing machine assembly set forth in claim 1, further characterized in that said basket assembly is removable.

9. The washing machine assembly set forth in claim 1, further characterized in that said refill drawer assembly mounts approximately horizontally within said washing machine.

10. The washing machine assembly set forth in claim 1, further characterized in that said refill drawer assembly comprises at least one refill housing.

11. The washing machine assembly set forth in claim 10, further characterized in that said at least one refill housing comprises a lid.

12. The washing machine assembly set forth in claim 10, further characterized in that said at least one refill housing stores and dispenses at least one agent within said washing machine, and said at least one agent is detergent, laundry detergent, bleach, and/or fabric softener.

13. The washing machine assembly set forth in claim 1, further characterized in that said electronic control panel is positioned exteriorly onto an interior panel of said refill drawer assembly.

14. The washing machine assembly set forth in claim 1, further characterized in that said washing machine comprises a light emitting diode system integrated onto a doorframe of said washing machine to illuminate said drum.

* * * * *